United States Patent [19]

Jackey et al.

[11] 4,430,158

[45] Feb. 7, 1984

[54] METHOD OF IMPROVING THE WET TENSILE STRENGTH OF GLASS FIBER MATS

[75] Inventors: Philip A. Jackey, Manville; V. Robert Canfield, Martinsville, both of N.J.

[73] Assignee: GAF Corporation, New York, N.Y.

[21] Appl. No.: 301,663

[22] Filed: Sep. 14, 1981

[51] Int. Cl.[3] ..... D21H 5/18

[52] U.S. Cl. ..... 162/156; 162/158; 162/166; 162/167

[58] Field of Search ..... 162/156, 166, 167, 158; 428/240, 436, 282

[56] References Cited

U.S. PATENT DOCUMENTS 4,178,203 12/1979 Chakrabarti ..... 162/156

4,258,098 3/1981 Bondoc et al. ..... 162/156

4,284,470 8/1981 Bondoc ..... 162/156

*Primary Examiner*—William F. Smith

*Attorney, Agent, or Firm*—Joshua J. Ward; J. Gary Mohr; Marilyn J. Maue

[57] ABSTRACT

What is described herein is a method of improving the wet tensile strength of sized glass fiber mats characterized by forming the mat from a plurality of glass fibers and a binder composition therefor which consists essentially of a urea-formaldehyde resin and about 0.01 to 5% by weight of a surfactant which is both highly water soluble and which wets the surfaces of sized glass fibers. The preferred surfactant is an anionic surfactant such as a sodium dodecylbenzene sulfonate. The glass mats thus made retained up to 79% of their tensile strength upon being subjected to severe wet conditions.

10 Claims, No Drawings

METHOD OF IMPROVING THE WET TENSILE STRENGTH OF GLASS FIBER MATS

BACKGROUND OF THE INVENTION

1. Field of the Invention

This invention relates to the manufacture of glass fiber mats by the wet-laid process and, more particularly, it is concerned with a method of improving the tensile strength of such mats upon being subjected to severe wet conditions.

2. Description of the Prior Art

Glass fiber mats are composed of glass fibers held together by a binder material. Typical binders used in the industry are urea-formaldehyde resins, phenolic resins, bone glue, polyvinyl alcohols, and latexes. These binder materials are impregnated directly into the fibrous mat and set or cured to provide the desired integrity for the glass fibers. The most widely used binder is urea-formaldehyde because it is inexpensive. Unfortunately, urea-formaldehyde binder is deficient in one or more respects for glass fiber mats. In particular, the tensile strengths of mats bound with urea-formaldehyde deteriorate appreciably when the mats are subjected to wet conditions, which are normally encountered in their use in roofing products. Such roofs may fail if their wet tensile strength is much lower than its dry tensile strength.

Accordingly, it is an object of this invention to provide glass fiber mat roofing shingles and built-up roofing products which retain a substantial portion of their dry tensile strength even under severe wet conditions.

SUMMARY OF THE INVENTION

The above stated objects and features of the invention are accomplished herein by providing a glass fiber mat composed of a plurality of sized glass fibers held together by an improved binder composition consisting essentially of a urea-formaldehyde resin and about 0.01 to 5%, preferably about 0.5%, by weight of a surfactant which is highly water soluble and which wets the surfaces of the sized glass fibers. Preferred surfactants having these physical characteristics are anionic surfactants such as sodium dodecylbenzene sulfonate.

The glass mats of the invention preferably are made by applying the binder composition directly to the wet glass mat, drying and curing the binder at elevated temperatures. The finished glass mat product contains about 60% to 90% by weight glass fibers and about 10% to 40% by weight of binder.

The glass mats made thereby retain up to 79% of their dry tensile strength when subjected to severe wet conditions.

DETAILED DESCRIPTION OF THE INVENTION

The following detailed description of the invention will be made with particular reference to a wet-laid process for preparing glass fiber mats, although it will be understood that other processes known in the art, such as a dry-laid process, may be used as well. Furthermore, the description is made using chopped bundles of sized glass fibers, although other forms of glass fibers such as continuous strands, also may be used.

The process of forming glass fiber mats according to the invention begins with chopped bundles of sized glass fibers of suitable length and diameter. Generally, fibers having a length of about 6 mm to 75 mm and a diameter of about 3 to 20 microns are used. Each bundle may contain from about 20 to 300, or more, of such fibers, which may be wet or dry, as long as they can be suitably dispersed in an aqueous dispersant medium. The bundles are added to the dispersant medium to form an aqueous slurry. Any suitable dispersant known in the art may be used. The fiber slurry then is agitated to form a workable dispersion at a suitable consistency. The dispersion then is passed to the screen of a mat-forming machine. En route to the screen, the dispersion usually is diluted with water to a lower fiber concentration.

The fibers are collected at the wire screen in the form of a wet fiber mat and the excess water is removed by vacuum in the usual manner. The wet mat now is ready for application of the binder composition thereto, which is accomplished by soaking the mat in an excess of binder solution and removing excess binder under vacuum. The mat then is dried and the binder composition is cured in an oven at elevated temperatures, generally at least about 200° C. This heat treatment alone will effect curing; alternatively, but less desirable, catalytic curing may be used, such as with an acid catalyst, e.g. ammonium chloride or p-toluene sulfonic acid.

The binder composition of the invention is prepared by blending a urea-formaldehyde resin with about 0.01 to 5% by weight of a suitable surfactant which is highly water soluble and which wets the surfaces of the sized glass fibers.

The urea-formaldehyde resins of the binder composition are commercially available materials; for example, urea-formaldehyde resins such as "S-3701-C" sold by Pacific Resins and Chemicals, Inc., Tacoma, Washington, and "PR-913-23", sold by Borden Chemical, Columbus, Ohio, may be used. These resins generally are modified with methylol groups which upon curing form methylene or ether linkages. Such methylols may include N,N'-dimethylol; dihydroxymethylolethylene; N,N'-bis(methoxymethyl), N,N'-dimethylolpropylene; 5,5-dimethyl-N,N'-dimethylolpropylene; N,N'-dimethylolethylene and the like.

The surfactants having the desired physical properties of being highly water soluble and of wetting the surfaces of the sized glass fibers are found most suitably among anionic surfactants, although cationic and nonionic surfactants may be used with lesser benefit on improving the wet tensile strength property of the glass mat.

The molecular structures of the anionic surfactants that are used to improve wet tensile strength in the current invention contain two essential segments:

(a) a hydrophobic segment containing from 8 to 30 carbon atoms, and (b) an anionic segment selected from among carboxy, sulfate ester, phosphate ester, sulfonic acid and phosphonic acid groups, generally in the form of their alkali metal, ammonium or alkylammonium salts. Optionally, the molecule may also contain a polyalkyleneoxy chain, but the number of alkyleneoxy units per molecule preferably should not exceed 10. The preferred alkyleneoxy unit is the ethyleneoxy unit.

The hydrophobic segment may be alkyl, aryl, alkaryl, substituted alkyl, substituted aryl or substituted alkaryl radicals. Furthermore, the alkyl groups can either be straight or branched chain and saturated or unsaturated. Suitable substituent groups, when present, include hydroxy, alkoxy, acyloxy, carboxy lower alkyls, thio, alkylthio, acylamide and halogen groups.

Examples of such anionic organic surfactant compounds are the water soluble alkali metal salts of organic sulfuric reaction products having in their molecular structure an alkyl radical containing from about 8 to about 30 carbon atoms and a radical selected from the group consisting of sulfonic acid and sulfuric acid ester radicals. (Included in the term alkyl is the alkyl portion of higher acyl radicals). Important examples of the synthetic surfactants which form a part of the present invention are the sodium or potassium alkyl sulfates, especially those obtained by sulfating the higher alcohols ($C_8$–$C_{18}$ carbon atoms), sodium or potassium alkyl benzene-sulfonates, such as are described in U.S. Pat. Nos. 2,220,009 and 2,477,383, in which the alkyl group contains from about 9 to about 15 carbon atoms; other examples of alkali metal alkylbenzene sulfonates are those in which the alkyl radical is a straight or branched chain aliphatic radical containing from about 10 to about 20 carbon atoms for instance, in the straight chain variety 2-phenyl-dodecane-sulfonate and 3-phenyl-dodecane-sulfonate; sodium alkyl glyceryl ether sulfonates, especially those ethers of the higher alcohols derived from tallow and coconut oil; sodium coconut oil fatty acid monoglyceride sulfates and sulfonates; sodium or potassium salts of sulfuric acid esters of the reaction product of one mole of a higher fatty alcohol (e.g. tallow or coconut oil alcohols) and about 1 to 6 moles of ethylene oxide; sodium or potassium salts or alkylphenol ethylene oxide ether sulfate with about 1 to about 10 units of ethylene oxide per molecule and in which the alkyl radicals contain about 9 to about 20 carbon atoms; the reaction product of fatty acids esterified with isethionic acid and neutralized with sodium hydroxide where, for example, the fatty acids are derived from coconut oil; sodium or potassium salts of fatty acid amide of a methyl tauride in which the fatty acids, for example, are derived from coconut oil; and others known in the art.

Other useful anionic surfactants are described in U.S. Pat. Nos. 3,844,952 and 3,976,586 and these are included by reference for use in the process of this invention.

Anionic surfactants, which perform best as additives for urea-formaldehyde, include Siponate DS-10, sodium dodecylbenzene sulfonate (Alcolac Chemical); Igepon TC-42, N-methyl-N-acyl-taurine, (GAF Corp.); Nekal WS-25, sodium bis(2,6-dimethyl 4heptyl)sulfosuccinate (GAF Corp.); Igepon TK-32, sodium N-methyl-N-tall oil and taurate (GAF Corp.) and Alipal CO-433, sodium nonylphenoxy polyethyleneoxy ether sulfate (GAF Corp.). Glass mats made from urea-formaldehyde and such surfactants retain up to 79% of the dry tensile strength under wet conditions. On the other hand, cationic and non-ionic surfactants which do not possess the required water solubility and ability to wet the sized glass fibers, provide mats which can retain much less of its dry tensile strength under wet conditions.

The following experimental examples will more fully describe the invention.

EXAMPLE 1

The Control 7.2 g. of 32 mm. length OCF 670 M sized glass fibers were dispersed by stirring in 12 l. of a 40 ppm solution of dimethylhydrogenated tallow amine oxide (DMHT-Armak Co.), a 0.06% by weight consistency. The dispersion was diluted to a 0.015% consistency en route to a dewatering screen where a wet web was formed. The wet web then was dipped into an aqueous binder solution of urea-formaldehyde (20% solids by weight). Thereafter excess binder was removed by vacuum and the mat was dried. The basis weight of the mat was about 110 g/m$^2$; the caliper was 1.0 mm; the urea-formaldehyde constituted about 23% by weight of the mat.

EXAMPLES 2–6

The Invention

The procedure of Example 1 was repeated except that the following surfactants were added in the given amounts per 497.5 g. of the binder solution (0.5% addition). A mat of similar physical parameters were obtained.

| Ex. No. | Surfactant | Amount (g.) | Activity (%) |
|---|---|---|---|
| 2 | Siponate DS-10 (Alcolac-sodium dodecylbenzene sulfonate) | 0.51 | 98 |
| 3 | Nekal WS-25 (GAF-sodium bis(2,6-dimethyl-4-heptyl)sulfosuccinate | 1.04 | 48 |
| 4 | Igepon TC-42 (GAF-sodium N—coconut acid-N—methyl taurate) | 2.00 | 25 |
| 5 | Igepon TK-32 (GAF-sodium N—methyl-N—tall oil acid taurate) | 2.50 | 20 |
| 6 | Alipal CO-433 (GAF-sodium nonylphenoxy polyethyleneoxy ether sulfate) | 1.67 | 30 |

EXAMPLES 7–10

The Comparison

| | | | |
|---|---|---|---|
| 7 | Gafac RE-610 (GAF-nonylphenoxy polyethyleneoxy phosphate) | 0.50 | 100 |
| 8 | Nekal BX-78 (GAF-sodium dibutyl naphthalene sulfonate) | 0.67 | 75 |
| 9 | Blancol N (GAF-sodium salt of sulfonated naphthalene formaldehyde condensate) | 0.58 | 86 |
| 10 | Darvan No. 1 (R.T. Vanderbilt-sodium naphthalene sulfonic acid formaldehyde condensate) | 0.50 | 100 |

The glass mats of Examples 1–10 were tested for their tensile strengths under dry conditions (dry tensile) and after thorough soaking in water for 10 minutes at 25° C., (wet tensile 25° C.) and for 10 minutes at 82° C. (wet tensile 82° C.). The tensile strengths were tested in accordance with GMFT-08 test using mat specimens 50 mm×200 mm in the machine direction (MD). The results were recorded as N/50 mm for the average of 5 samples. The samples had a tear strength of about 7 N. The results are given in the Table below.

TABLE

| Ex. No. | Tensile Strengths Dry | Tensile Strengths Wet (25° C.) | Retention % of Dry Tensile | Tensile Strengths Dry | Tensile Strengths Wet (82° C.) | Retention % of Dry Tensile |
|---|---|---|---|---|---|---|
| 1-Control | 204 | 32 | 16 | 204 | 14 | 7 |
| 2-Invention | 388 | 224 | 57 | 388 | 48 | 13 |
| 3-Invention | 312 | 212 | 68 | 312 | 64 | 21 |
| 4-Invention | 316 | 168 | 53 | 316 | 64 | 20 |
| 5-Invention | 282 | 224 | 79 | 282 | 112 | 40 |
| 6-Invention | 252 | 122 | 48 | 252 | 50 | 20 |
| 7-Comparison | 100 | 16 | 16 | 100 | 6 | 6 |
| 8-Comparison | 126 | 14 | 11 | 126 | — | — |
| 9-Comparison | 225 | 63 | 28 | 225 | 28 | 12 |
| 10-Comparison | 197 | 44 | 22 | 197 | 22 | 11 |

The results in the Table above demonstrate that the addition to the urea-formaldehyde binder of a surfactant which is highly soluble in water and which wets the surfaces of the sized glass fibers (the anionic surfactants of Examples 2–6) result in a pronounced increase in percent retention of dry tensile strength under wet conditions at both room and elevated temperatures, whereas those relatively non-water soluble surfactants which do not wet the sized glass fibers (Examples 7–10) do not improve upon the wet tensile strength properties of the control.

What is claimed is:

1. A method of making a glass fiber mat having improved wet tensile strength properties comprising:

(a) forming a plurality of enmeshed sized glass fibers in a wet-laid process, (b) adding a binder composition consisting essentially of urea-formaldehyde and a surfactant for said thus-formed mat, said surfactant being highly water soluble and capable of wetting the surfaces of the sized glass fibers and being selected from the group consisting of anionic surfactants, said anionic surfactants having hydrophobic segments containing from 8 to 30 carbon atoms and anionic segments selected from among carboxy, sulfate ester, phosphate ester, sulfonic acid and phosphonic acid groups; and (c) drying the glass mat having the binder thereon.

2. A method according to claim 1 wherein said surfactant is present in an amount of about 0.1 to 5% by weight of the binder.

3. A method according to claim 1 wherein said surfactant is an anionic surfactant in the form of an alkali metal, ammonium or alkyl ammonium salt and is present in an amount between about 0.1 and about 5% by weight of the binder.

4. A method according to claim 1 wherein said surfactant is a dodecylbenzene sulfonate, an N-methyl-N-acyl-taurine, a dialkyl ester of a sulfosuccinate, an N-methyl-N-tall oil acid taurate, or a nonylphenoxy polyethyleneoxy ether sulfate.

5. A method according to claim 4 wherein the surfactant is present in an amount of about 0.1 to 5% by weight of the binder.

6. Glass fiber mat made according to the method of claim 1.

7. Glass fiber mat made according to the method of claim 2.

8. Glass fiber mat made according to the method of claim 3.

9. Glass fiber mat made according to the method of claim 4.

10. Glass fiber mat made according to the method of claim 5.

* * * * *